US006956547B2

(12) United States Patent
Bae et al.

(10) Patent No.: US 6,956,547 B2
(45) Date of Patent: Oct. 18, 2005

(54) DRIVING CIRCUIT AND METHOD OF DRIVING AN ORGANIC ELECTROLUMINESCENCE DEVICE

(75) Inventors: Sung-Joon Bae, Kyungki-Do (KR); Han-Sang Lee, Kyungki-Do (KR); Myung-Ho Lee, Kyungki-Do (KR); Joon-Kyu Park, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 441 days.

(21) Appl. No.: 10/176,537

(22) Filed: Jun. 24, 2002

(65) Prior Publication Data

US 2003/0001806 A1 Jan. 2, 2003

(30) Foreign Application Priority Data

Jun. 30, 2001 (KR) ..... 2001-38910
May 16, 2002 (KR) ..... 2002-27202

(51) Int. Cl.[7] ..... G09G 3/30

(52) U.S. Cl. ..... 345/77; 345/690; 345/213; 315/169.3

(58) Field of Search ..... 345/76–81, 88–89, 345/690–691, 213; 315/169.1, 169.3

(56) References Cited

U.S. PATENT DOCUMENTS 6,188,453 B1 * 2/2001 Matsuoka et al. ..... 349/54
6,310,589 B1 * 10/2001 Nishigaki et al. ..... 345/76
6,417,825 B1 * 7/2002 Stewart et al. ..... 345/77
2001/0019319 A1 * 9/2001 Kim ..... 345/77
2003/0058195 A1 * 3/2003 Adachi et al. ..... 345/67
2003/0071772 A1 * 4/2003 Kimura ..... 345/76

* cited by examiner

*Primary Examiner*—Amr A. Awad
(74) *Attorney, Agent, or Firm*—McKennaa Long & Aldridge LLP

(57) ABSTRACT

A driving circuit in an organic electroluminescent device includes a gate driver unit for sequentially outputting a control signal to select gate lines in a luminescent array unit and a current driver unit for supplying picture data to a data lines in the luminescent array unit corresponding to the gate lines selected by the gate driver unit and selectively driving organic electroluminescent devices of the selected line. The driving circuit includes a minimum gray level judgment unit for determining whether the picture data is of a predetermined minimum gray level; and a switching unit for receiving a control signal according to the determination made by the minimum gray level judgment unit and for selectively supplying a reference voltage or a reference current to the selectively driven organic electroluminescent devices.

16 Claims, 12 Drawing Sheets

DRIVING CIRCUIT AND METHOD OF DRIVING AN ORGANIC ELECTROLUMINESCENCE DEVICE

This application claims the benefit of Korean Patent Application Nos. 2001-38910, filed on Jun. 30, 2001 and 2002-27202, filed on May 16, 2002, which is hereby incorporated by reference for all purposes as if fully set forth herein.

BACKGROUND OF THE INVENTION

1. Field of the Invention

The present invention relates to a driving circuit and a method of driving an active-matrix type organic electroluminescent device, and more particularly to a driving circuit and a method of driving an organic electroluminescent device having the capability of shortening a time required to display picture data on a screen, wherein the picture data applied from a current driver integrated circuit (IC) is of a minimum gray level.

2. Discussion of the Related Art

A related art organic electroluminescent device driving circuit will now be described with reference to the accompanying drawings.

FIG. 1 generally illustrates a block diagram of a driving circuit used in an active-matrix type organic electroluminescent device. The driving circuit includes a gate driver unit 20 for sequentially outputting a control signal to select gate lines in a luminescent array unit 10 and a current driver unit 30 for supplying picture data to data lines in the luminescent array unit 10 corresponding to gate lines that are selected by the gate driver unit 20 and selectively driving organic electroluminescent devices connected to the selected line.

FIG. 2 illustrates a driving circuit unit used in an organic electroluminescent device. The driving circuit unit includes first and second PMOS transistors PM1 and PM2, wherein the sources of the first and second PMOS transistors are connected to a power voltage (VDD) and wherein the gates of the first and second PMOS transistors are commonly connected; a first capacitor C1 connected between the power voltage (VDD) and the commonly connected gates of the first and second PMOS transistors PM1 and PM2; an organic electroluminescent device 11 connected between a drain of the first PMOS transistor PM1 and a ground (VSS); a source of a third PMOS transistor PM3 connected to the commonly connected gates of the first and second PMOS transistors; a drain of the third PMOS transistor PM3 connected to a drain of the second PMOS transistor PM2, so as to be energized as a gate of the third PMOS transistor receives a control signal from the gate driver unit 20; a source of a fourth PMOS transistor PM4 connected to commonly connected drains of the second and third PMOS transistors PM2 and PM3, so as to be energized as a gate of the fourth PMOS transistor receives a control signal of the gate driver unit 20; and a first NMOS transistor NM1 connected between a drain of the fourth PMOS transistor PM4 and the ground (VSS), so as to be energized as a gate of the first NMOS transistor NM1 receives an analog voltage, corresponding to the picture data from the current driver 30.

An operation of the electroluminescent device illustrated in FIGS. 1 and 2 will now be described.

When a line in the luminescent array unit 10 is selected by a control signal from the gate driver unit 20 shown in FIG. 1, a low potential signal is applied from the driving circuit unit in the organic electroluminescent device to the gates of the third and fourth PMO transistors PM3 and PM4, so that the third and fourth PMOS transistors PM3 and PM4 shown in FIG. 2 may be energized.

Analog voltages, corresponding to picture data, may be applied from the current driver unit shown in FIG. 1 to the gate of the first NMOS transistor NM1 shown in FIG. 2. In applying the analog voltages, the degree to which the first NMOS transistor NM1 is energized may be controlled.

A proper voltage value may therefore be outputted from the current driver unit 30 according to the gray level characteristics of each of the individual organic electroluminescent devices 11. For example, if a gray level is to be implemented as a 8 bit digital data signal, the current driver 30 converts digital values between a predetermined maximum gray level of, for example, '11111111' and a predetermined minimum gray level of, for example, '00000000' to analog voltage values using a digital/analog converter. The digital/analog converter applies the analog voltage values to gates of the first NMOS transistors NM1, thereby controlling the degree to which the first NMOS transistors NM1 are energized.

When the third and fourth PMOS transistors PM3 and PM4 are energized, a predetermined amount of current flows through a first route beginning at the power voltage (VDD) to the second and fourth PMOS transistors PM2 and PM4, from the second and fourth PMOS transistors to the first NMOS transistor NM1, and from the first NMOS transistor to ground (VSS). The predetermined amount of current flows through the first route according to the degree to which the first NMOS transistor NM1 is energized by the analog voltage value supplied from the current driver unit 30. According to the principles of current mirroring, a predetermined amount of current also flows through a second route beginning at the power voltage (VDD) then flowing to the first PMOS transistor PM1, then to the organic electroluminescent device 11, and lastly to ground (VSS) thereby controlling luminescent characteristics of the organic electroluminescent device 11.

If a predetermined maximum gray level is to be displayed by the organic electroluminescent device 11, the current driver unit 30 converts a digital value of, for example, '11111111' into a corresponding analog voltage value and applies the corresponding analog voltage value to the gate of the first NMOS transistor NM1. Then, the degree to which the first NMOS transistor NM1 is energized, is maximized allowing a maximum amount of current to flow through the first route. Accordingly, a maximum amount of current also flows through the second route, so that the predetermined maximum gray level may be displayed by the organic electroluminescent device 11.

If a predetermined minimum gray level is to be displayed by the organic electroluminescent device 11, the current driver unit 30 converts a digital value of, for example, '00000000' into a corresponding analog voltage value and applies the corresponding analog voltage to the gate of the first NMOS transistor NM1. Then, the first NMOS transistor NM1 is turned off, e.g., placed in a floating state, such that no current flows through either the first or second routes so that the predetermined minimum gray level may be displayed by the organic electroluminescent device 11.

The gate driver unit 20 sequentially outputs a series of control signals so that the first through the last gate lines in the luminescent array unit 10, in which a plurality of the organic electroluminescent devices 11 are arranged, may be sequentially selected to display one frame of a picture on a screen.

Assuming that the organic electroluminescent device 11 illustrated in FIG. 2 is coupled to the first gate line in the luminescent array unit 10, the third and fourth PMOS transistors PM3 and PM4 may be energized when the first line is selected by the gate driver unit 20. Accordingly, an analog voltage value specific to the organic electroluminescent device 11 may be applied to the gate of the first NMOS transistor NM1 by the current driver unit 30 to control the degree to which the first NMOS transistor NM1 is energized. Accordingly, a predetermined amount of current flows to the first and second routes so that a proper gray level may be displayed by the organic electroluminescent device 11.

After the first gate line has been selected by the gate driver unit 20, the next consecutive gate line is selected and the third and fourth PMOS transistors PM3 and PM4 coupled to the first gate line are turned off. Accordingly, the gray level of the corresponding organic electroluminescent device 11 on the first gate line is maintained by the first capacitor C1 until the last gate line in the luminescent array unit 10 is selected, thereby displaying one frame of a picture on a screen.

However, the related art driving circuit illustrated in FIGS. 1 and 2 has the following problem. When an organic electroluminescent device consecutively displays a maximum gray level in a first frame of a picture and then again in a second frame, the first NMOS transistor NM1 energized in the first picture frame turned off and induced into a floating state. The voltage charged in the first capacitor C1 is then gradually reduced from the maximum gray level to the minimum gray level. Accordingly, it is impossible to accurately display the appropriate gray level within an organic electroluminescent device. Further, it becomes difficult to drive the organic electroluminescent devices with a quick response speed.

SUMMARY OF THE INVENTION

Accordingly, the present invention is directed to a driving circuit and a method of driving an organic electroluminescent device that substantially obviates one or more of the problems due to limitations and disadvantages of the related art.

Accordingly, an advantage of the present invention provides a driving circuit and a method of driving an organic electroluminescent device having the capability of shortening a time required to display picture data on a screen if the picture data is supplied from a current driver integrated circuit and is of a minimum gray level.

Additional features and advantages of the invention will be set forth in the description that follows, and in part will be apparent from the description, or may be learned by practice of the invention. Other advantages of the invention will be realized and attained by the structure particularly pointed out in the written description and claims hereof as well as the appended drawings.

To achieve these and other advantages and in accordance with the purpose of the present invention, as embodied and broadly described herein, there is provided an organic electroluminescent device driving circuit having a gate driver unit for sequentially outputting a control signal to select gate lines in a luminescent array unit and a current driver unit for supplying picture data to data lines in the luminescent array unit corresponding to gate lines that are selected by the gate driver unit and, therefore, driving organic electroluminescent devices connected to the selected line. The driving circuit includes a minimum gray level judgment unit for determining whether the picture data applied from the current driver unit to a specific organic electroluminescent device within the luminescent array unit is of a predetermined minimum gray level; and a switching unit for receiving a control signal dependent on the determination by the minimum gray level judgment unit and for selectively supplying (e.g., turning on and/or turning off) a reference voltage to the selected organic electroluminescent device.

To achieve these and other advantages and in accordance with the purpose of the present invention, as embodied and broadly described, there is also provided an organic electroluminescent device driving circuit including a gate driver unit for sequentially outputting a control signal to select gate lines in a luminescent array unit and a current driver unit for supplying picture data to data lines in the luminescent array unit corresponding to gate lines that are selected by the gate driver unit and selectively driving organic electroluminescent devices connected the selected line. The driving circuit includes a minimum gray level judgment unit for determining whether the picture data applied from the current driver unit to a specific organic electroluminescent device within the luminescent array unit is of a minimum gray level; and a switching unit for receiving a control signal dependent on the determination by the minimum gray level judgment unit and for selectively supplying (e.g., turning on and/or turning off) a reference current to the specific organic electroluminescent device.

To achieve these and other advantages and in accordance with the purpose of the present invention, as embodied and broadly described, there is provided an organic electroluminescent device driving method including the steps of reading picture data supplied to a plurality of organic electroluminescent devices within a luminescent array unit that are selected by a gate driver unit and a current driver unit; determining whether the read picture data is of a minimum gray level; and using the picture data to drive the organic electroluminescent devices with the current driver unit wherein the current driver unit supplies current to predetermined organic electroluminescent devices if the picture data is not of the minimum gray level, and wherein the current driver unit cuts off the current supplied to the predetermined organic electroluminescent devices if the picture data is of the minimum gray level. Accordingly, if the picture data is of the minimum gray level, a reference voltage is supplied to the predetermined organic electroluminescent devices.

To achieve the above advantages, there is provided an organic electroluminescent device driving method including the steps of reading picture data supplied to a plurality of organic electroluminescent devices within a luminescent array unit that are selected by a gate driver unit and a current driver unit; determining whether the read picture data is of a minimum gray level; and using the picture data to drive the organic electroluminescent devices with the current driver unit, wherein the current driver unit supplies current to predetermined organic electroluminescent devices if the picture data is not of the minimum gray level, and wherein the current driver unit cuts off the current supplied to the predetermined organic electroluminescent devices if the picture data is of the minimum gray level. Accordingly, if the picture data is of the minimum gray level, a reference current is supplied to the predetermined organic electroluminescent devices.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included herewith to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings.

A driving circuit and method of driving an organic electroluminescent device in accordance with the present invention will now be described in detail with reference to the accompanying drawings.

Figure 1:
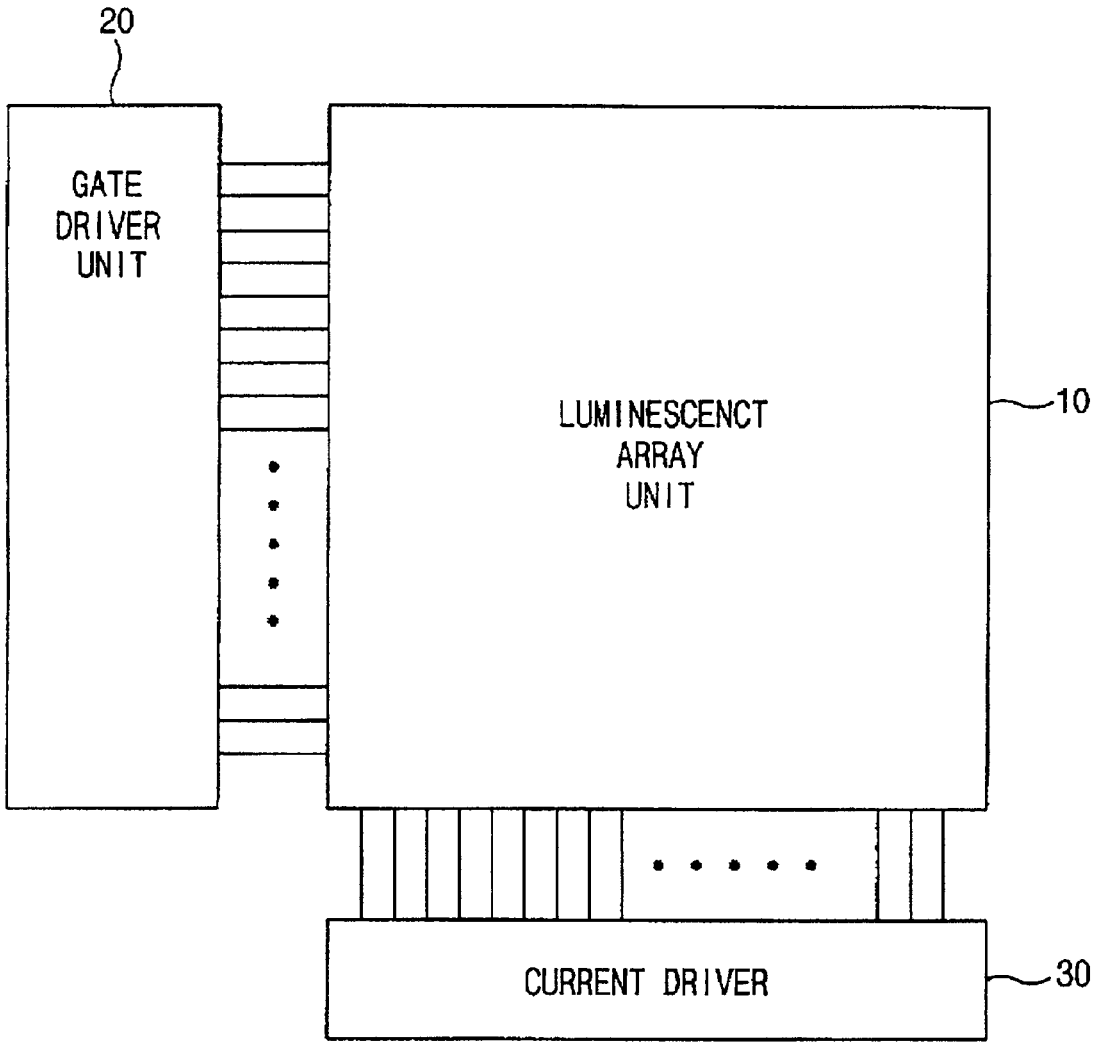
FIG. 1 RELATED ART
FIG. 1 illustrates a block diagram of a driving circuit of a related art organic electroluminescent device.
Figure 2:
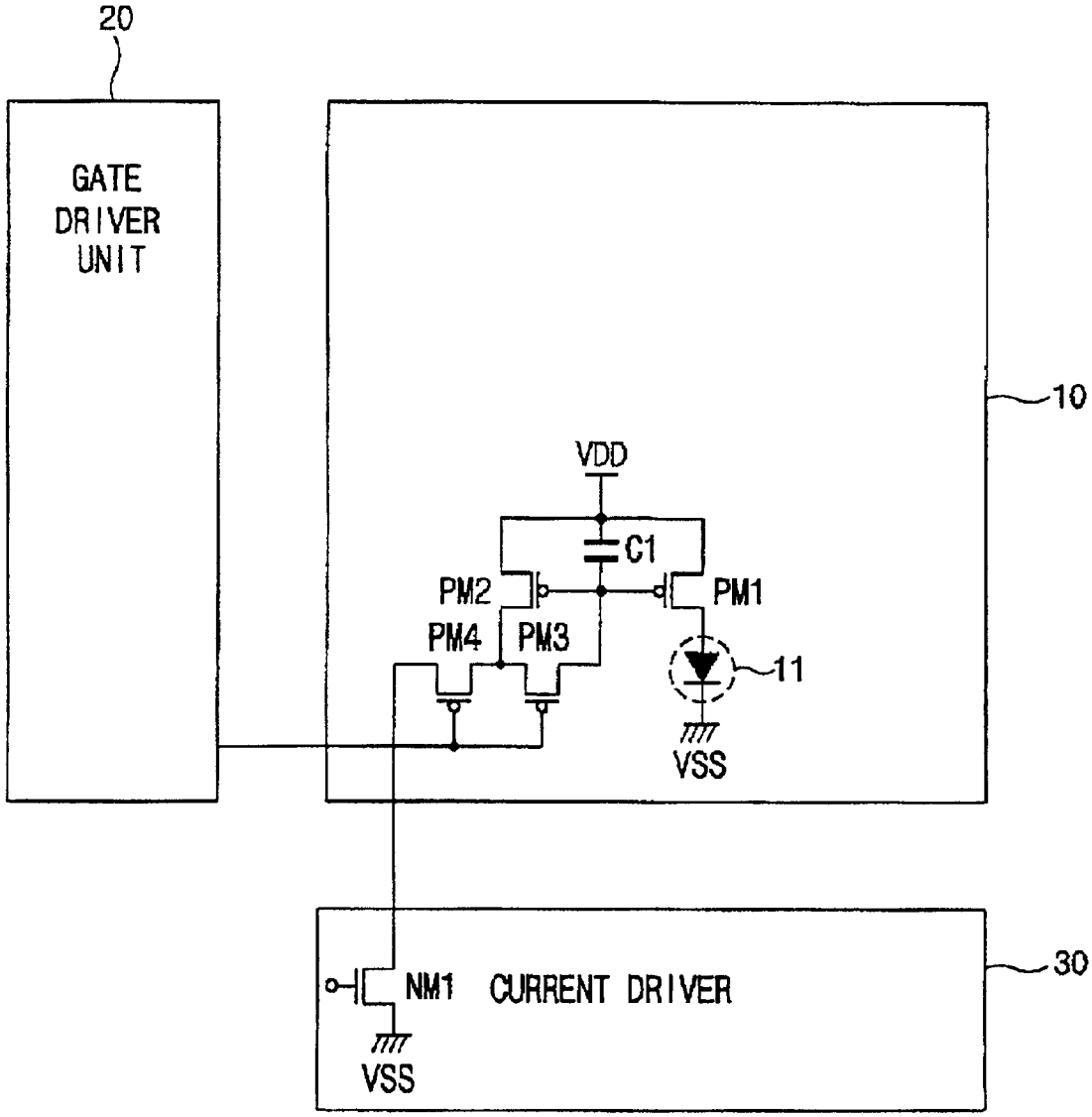
FIG.2 RELATED ART
FIG. 2 illustrates an exemplary view of a driving circuit for a unit organic electroluminescent device shown in FIG. 1.
Figure 3:
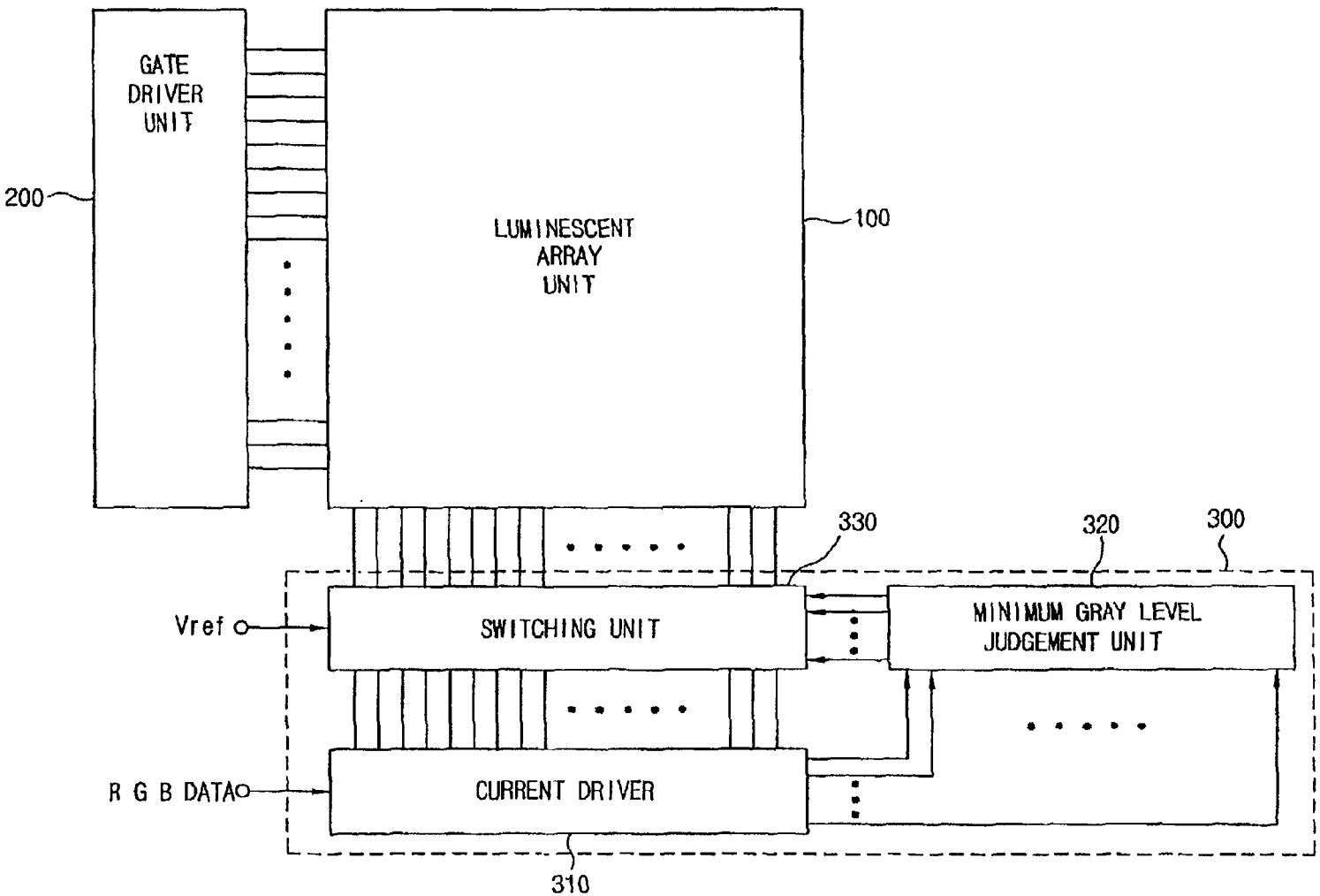
FIG. 3 illustrates a block diagram of a driving circuit of an organic electroluminescent device in accordance with one embodiment of the present invention.

FIG. 3 illustrates a block diagram of an organic electroluminescent device driving circuit in accordance with one embodiment of the present invention.

Referring to FIG. 3, the organic electroluminescent device driving circuit in accordance with one embodiment of the present invention includes a gate driver unit 200 for sequentially outputting a control signal to select gate lines in a luminescent array unit 100; and a current driver unit 300 for supplying picture data (e.g., RGB data) to data lines in the luminescent array unit 100 corresponding to gate lines that are selected by the gate driver unit 200 and, therefore, driving organic electroluminescent devices connected to the selected line. The current driver unit 300 includes a current driver 310 for receiving a digital picture data signal (e.g., an RGB data signal) from an external data source (not shown) and supplying the picture data to the data lines in the luminescent array unit 100 corresponding to gate lines that are selected by the gate driver unit 200 and, therefore, selectively driving the organic electroluminescent devices connected to the selected line; a minimum gray level judgment unit 320 for determining whether the picture data applied from the current driver 310 to the selected organic electroluminescent device within the luminescent array unit 100 is of a predetermined minimum gray level; and a switching unit 330 for receiving a control signal dependent on the determination by the minimum gray level judgment unit 320 and for selectively supplying (e.g., turning on and/or turning off) a reference voltage (Vref) to the selected organic electroluminescent device.

The reference voltage (Vref) may be supplied through a voltage driver (not shown).

Figure 4:
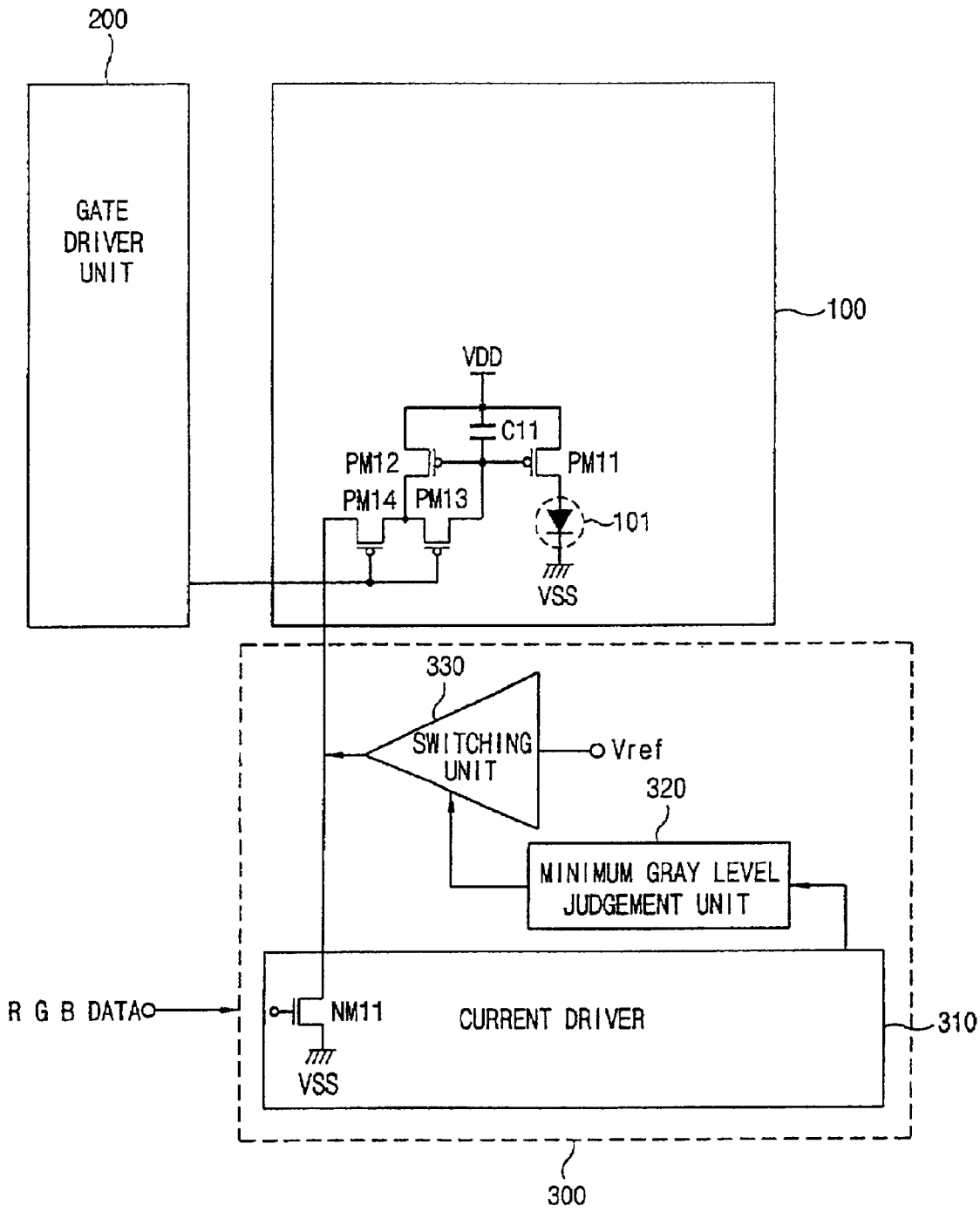
FIG. 4 illustrates a detailed exemplary view of a driving circuit unit in an organic electroluminescent device shown in FIG. 3.

FIG. 4 illustrates an exemplary view of an organic electroluminescent device driving circuit used in the shown in FIG. 3.

Referring to FIG. 4, the organic electroluminescent device driving circuit of the present invention includes first and second PMOS transistors PM11 and PM12, wherein the sources of the first and second PMOS transistors are connected to a power supply voltage (VDD) and wherein gates of the first and second PMOS transistors are commonly connected; a first capacitor C11 connected between the power supply voltage (VDD) and the commonly connected gates of the first and second PMOS transistors PM11 and PM12; an organic electroluminescent device 101 connected between a drain of the first PMOS transistor PM11 and a ground (VSS); a source of a third PMOS transistor PM13 connected to the commonly connected gates of the first and second PMOS transistors; a drain of the third PMOS transistor PM13 connected to a drain of the second PMOS transistor PM12, so as to be energized as a gate of the third PMOS transistor receives a control signal from the gate driver unit 200; a source of a fourth PMOS transistor PM14 connected to the commonly connected drains of the second and third PMOS transistors PM12 and PM13, so as to be energized as a gate of the fourth PMOS transistor receives a control signal from the gate driver unit 200; a first NMOS transistor NM11, included within the current driver 310, connected between a drain of the fourth PMOS transistor PM14 and the ground (VSS), so as to be energized as a gate of the first NMOS transistor receives a gray level analog voltage corresponding to the picture data; a minimum gray level judgment unit 320 for receiving a digital value of the gray level analog voltage from the current driver 310 and determining whether the digital value of the gray level analog voltage is of a predetermined minimum gray level; and a switching unit 330 for receiving a control signal according to the determination of the minimum gray level judgment unit 320 and selectively supplying (e.g., turning on and/or turning off) a reference voltage (Vref) to the first NMOS transistor NM11.

A driving circuit operation in accordance with one embodiment of the present invention will now be described.

Referring back to FIG. 3, when a gate line within the luminescent array unit 100 is receives a control signal from the gate driver unit 200, a low potential signal from the organic electroluminescent device driving circuit is applied to the gates of the third and fourth PMOS transistors PM13 and PM14 so that the third and fourth PMOS transistors PM13 and PM14 may be energized.

As shown in FIG. 4, within the current driver unit 300, the gray level analog voltage corresponding to the picture data is applied to the gate of the first NMOS transistor NM11 thereby controlling the degree to which the first NMOS transistor NM11 is energized.

A proper voltage value may therefore be outputted from the current driver unit 300 according to the gray level characteristics of each of the individual organic electroluminescent devices 101. For example, if a gray level is to be implemented as a 8 bit digital data signal, the current driver 300 converts digital values between a predetermined maximum gray level of, for example, '11111111' and a predetermined minimum gray level of, for example, '00000000' to analog voltage values through a digital/analog converter. The current driver 300 then applies the analog voltage values to the gates of the first NMOS transistors NM11, thereby controlling the degree to which the first NMOS transistors NM11 are energized.

When the third and fourth PMOS transistors PM13 and PM14 are energized, a predetermined amount of current flows through a first route beginning at the power voltage (VDD) to the second and fourth PMOS transistors PM13 and PM14, from the second and fourth transistors to the first NMOS transistor NM11, and from the first NMOS transistor to ground (VSS). The predetermined amount of current flows through the first route according to the degree to which the first NMOS transistor NM11 is energized by the analog voltage value supplied from the current driver unit 300. According to the principles of current mirroring, a predetermined amount of current also flows through a second route beginning at the power voltage (VDD) then flowing to the first PMOS transistor PM11, then to the organic electroluminescent device 101, and lastly to ground (VSS) thereby controlling luminescence characteristics of the organic electroluminescent device 101.

If a predetermined maximum gray level is to be displayed by the organic electroluminescent device 101, the current driver unit 300 converts a digital value of, for example, '11111111' into a corresponding gray level analog voltage value and applies the corresponding gray level analog voltage value to the gate of the first NMOS transistor NM11. Then, the degree to which the first NMOS transistor NM11 is energized, is maximized allowing a maximum amount of current to flow through the first route. Accordingly, the maximum amount of current also flows through the second route so that the predetermined maximum gray level may be displayed by the organic electroluminescent device 101.

If a predetermined minimum gray level is to be displayed by the organic electroluminescent device 101, the current driver unit 300 converts a digital value of, for example, '00000000' into a corresponding gray level analog voltage value and applies the corresponding gray level analog voltage value to the gate of the first NMOS transistor NM11. Then, the first NMOS transistor NM11 is turned off, e.g., placed in a floating state, such that no current flows through either the first or second routes so that the predetermined minimum gray level may be displayed by the organic electroluminescent device 101.

The gate driver unit 200 outputs a series of control signals so that the first through last gate lines in the luminescent array unit 100, in which a plurality of the organic electroluminescent devices 101 are arranged, may be sequentially selected to display one frame of a picture on a screen.

Assuming that the organic electroluminescent device 101 illustrated in FIG. 4 is coupled to the first gate line of the luminescent array unit 100, the third and fourth PMOS transistors PM13 and PM14 may be energized when the first line is selected by the gate driver unit 200. Accordingly, an analog voltage value specific to the organic electroluminescent device may be applied to the gate of the first NMOS transistor NM11 by the current driver unit 300 to control the degree to which the first NMOS transistor NM11 is energized. Accordingly, a predetermined amount of current flows through the first and second routes so that a proper gray level may be displayed by the organic electroluminescent device 101.

After the first gate line has been selected by the gate driver unit 200, the next consecutive gate line is selected and the third and fourth PMOS transistors PM13 and PM14 coupled to first gate line are turned off. Accordingly, the gray level of the corresponding organic electroluminescent device 101 is maintained by the first capacitor C11 until the last gate line in the luminescent array unit 100 is selected, thereby displaying one frame of a picture on a screen.

Figure 5:
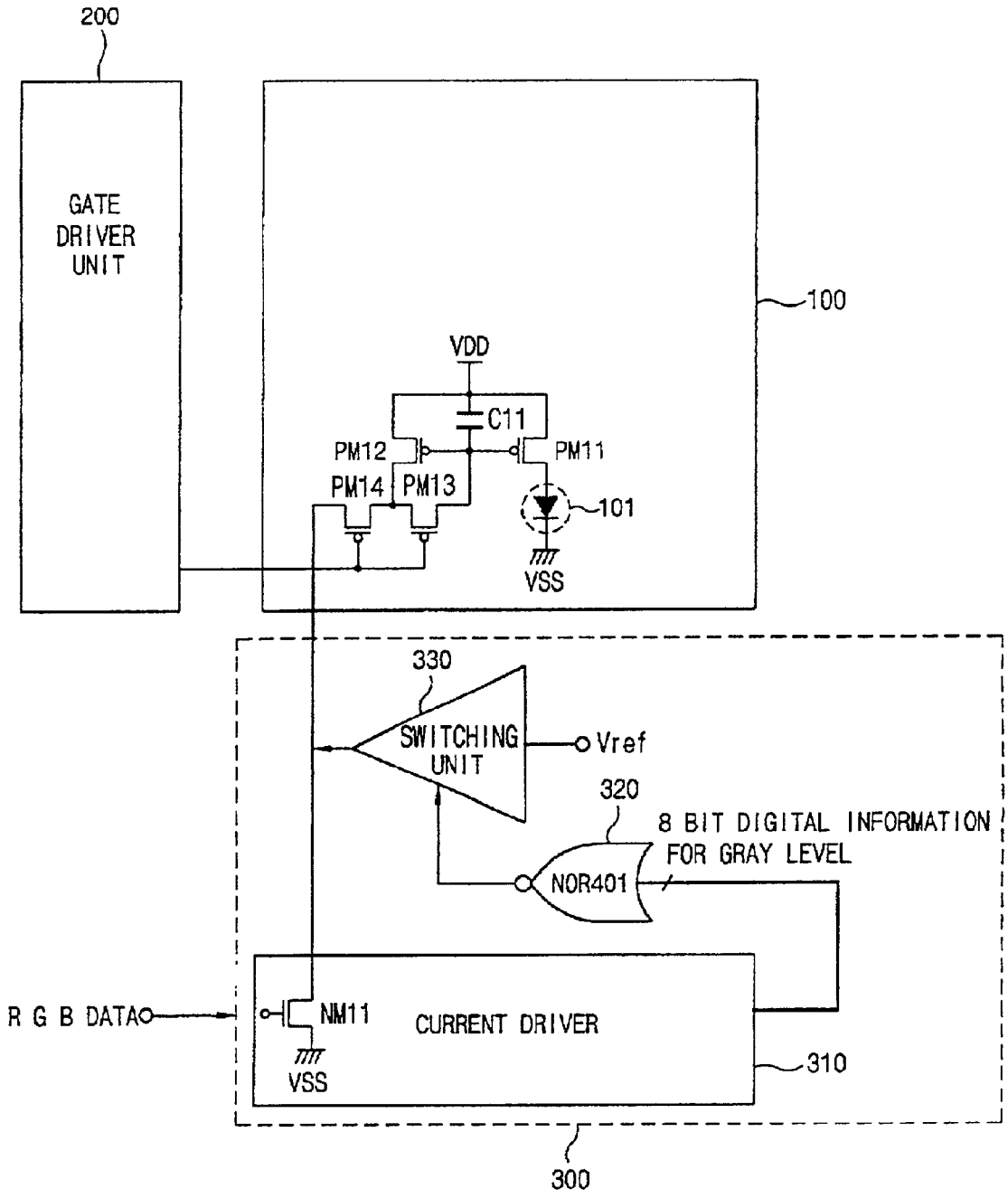
FIG. 5 illustrates a detailed exemplary view of a minimum gray level judgment unit and a switching unit shown in FIG. 4.

Referring now to FIG. 5, as discussed above, the minimum gray level judgment unit 320 may be installed in the current driver unit 300. The minimum gray level judgment unit 320 may include a NOR gate NOR401 that performs a NOR operation on the digital value of the gray level for the organic electroluminescent device generated by the current driver 310. Accordingly, when a digital value of a predetermined minimum gray level of, for example, '00000000' is inputted, the minimum gray level judgment unit 320 selectively outputs a logical 'high' potential, thereby indicating that the digital value has been determined to be of the predetermined minimum gray level.

The NOR gate NOR401 may be altered using an inverter. Accordingly, the inverter may invert the digital value of the gray level for an organic electroluminescent device outputted from the current driver 310. Further, an AND gate may be added to perform an AND operation on the output of the inverter in order to obtain the same output value.

Referring to FIG. 5, the switching unit 330 selectively supplies a reference voltage (Vref) to the first route if the NOR gate NOR401 outputs a logical 'high' potential.

A method of driving the organic electroluminescent device of the present invention will now be described with reference to FIG. 6.

Figure 6:
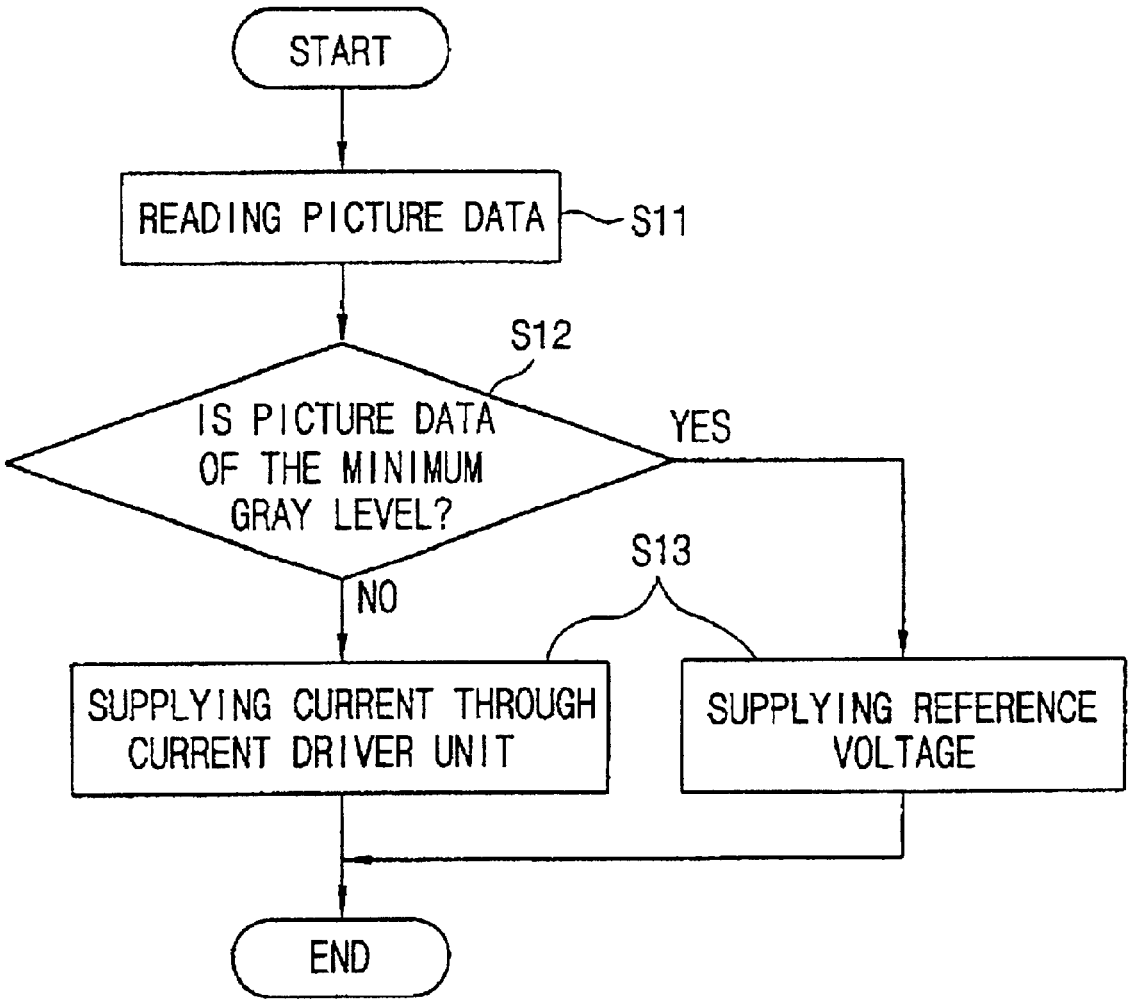
FIG. 6 illustrates a flow chart of a method of driving the organic electroluminescent device in accordance with the present invention.

Referring to FIG. 6, picture data is supplied to the organic electroluminescent device that is selected by the gate driver unit and the current driver unit is read (step S11)

Next, it is determined whether the read picture data contains a digital value of a predetermined minimum gray level (step S12).

If the picture data does not contain a digital value of the predetermined minimum gray level, the corresponding organic electroluminescent device luminesces using current received from the current driver unit. If, however, the picture data does contain a digital value of the predetermined minimum gray level, the corresponding organic electroluminescent device receives no current from the current driver unit. However, a reference voltage is supplied to the corresponding organic electroluminescent device (step S13).

Accordingly, when an organic electroluminescent device displays a predetermined gray level in a first frame of a picture and then displays the predetermined minimum gray level in a second, consecutive, frame, the reference voltage (Vref) may be supplied to the first route so that the organic electroluminescent device can display the predetermined gray level and then immediately display the minimum gray level.

Figure 7:
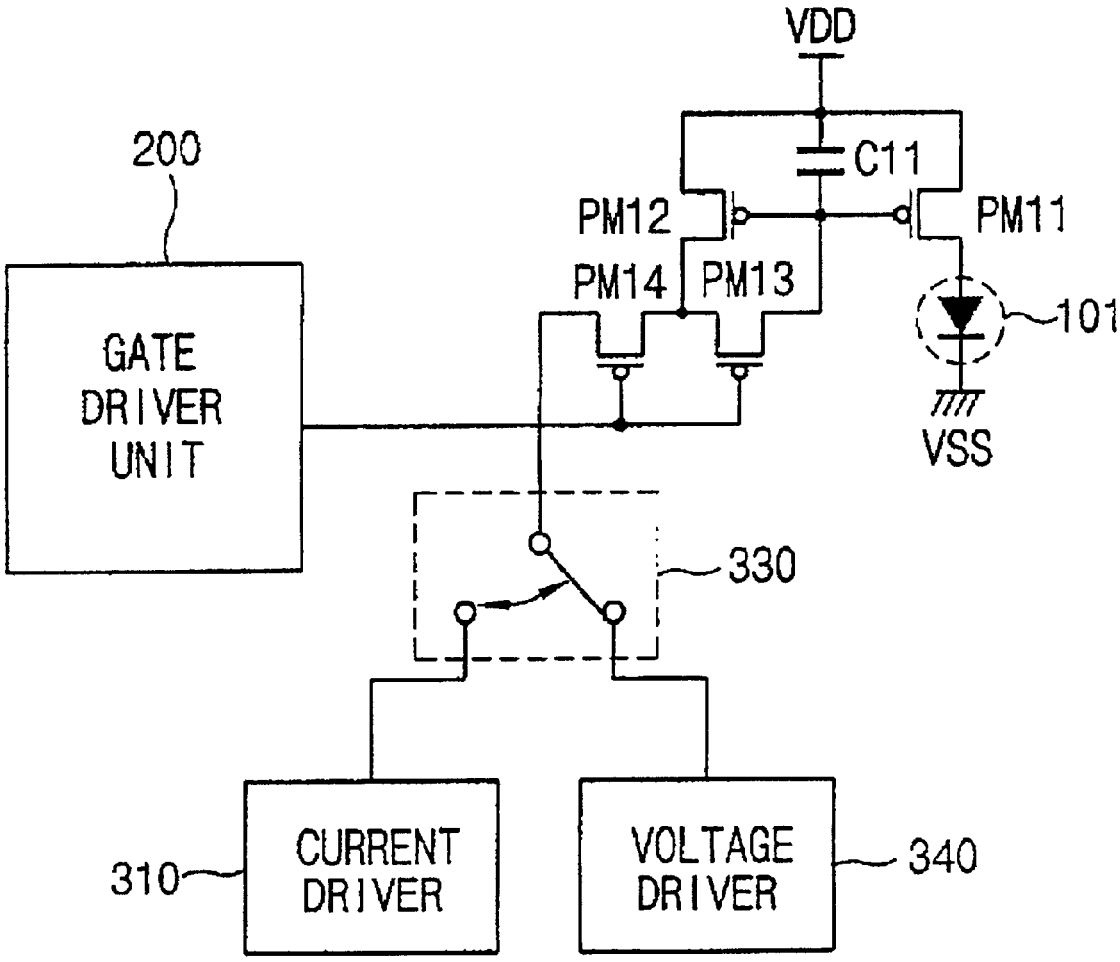
FIG. 7 illustrates an exemplary view of a driving apparatus of an organic electroluminescent device in accordance with one embodiment of the present invention.

FIG. 7 illustrates an exemplary view of a driving apparatus of an organic electroluminescent device in accordance with one embodiment of the present invention.

Referring to FIG. 7, when the organic electroluminescent device 101 displays a predetermined gray level, the current driver 310 may be connected to the organic electroluminescent device driving circuit via the switching unit 330, and the third and fourth PMOS transistors PM13 and PM14. An analog voltage corresponding to the digital picture data signal may be applied to the gate of the first NMOS transistor NM11 to control the degree to which the first NMOS transistor NM11 is energized. Accordingly, the current flowing to the organic electroluminescent device 101 may be controlled as required such that a predetermined gray level is displayed by the organic electroluminescent device.

When the organic electroluminescent device 101 displays a predetermined minimum gray level, the first NMOS transistor NM11 is turned off. Further, the voltage driver 340 supplies the reference voltage (Vfref) to the organic electroluminescent device driving circuit via a connection made by the switching unit 330. When the organic electroluminescent device 101 displays the predetermined minimum gray level, the first and second PMOS transistors PM11 and PM12 are turned off and the current flowing to the organic electroluminescent device 101 is turned off so that the predetermined minimum gray level is displayed by the organic electroluminescent device.

Figure 8:
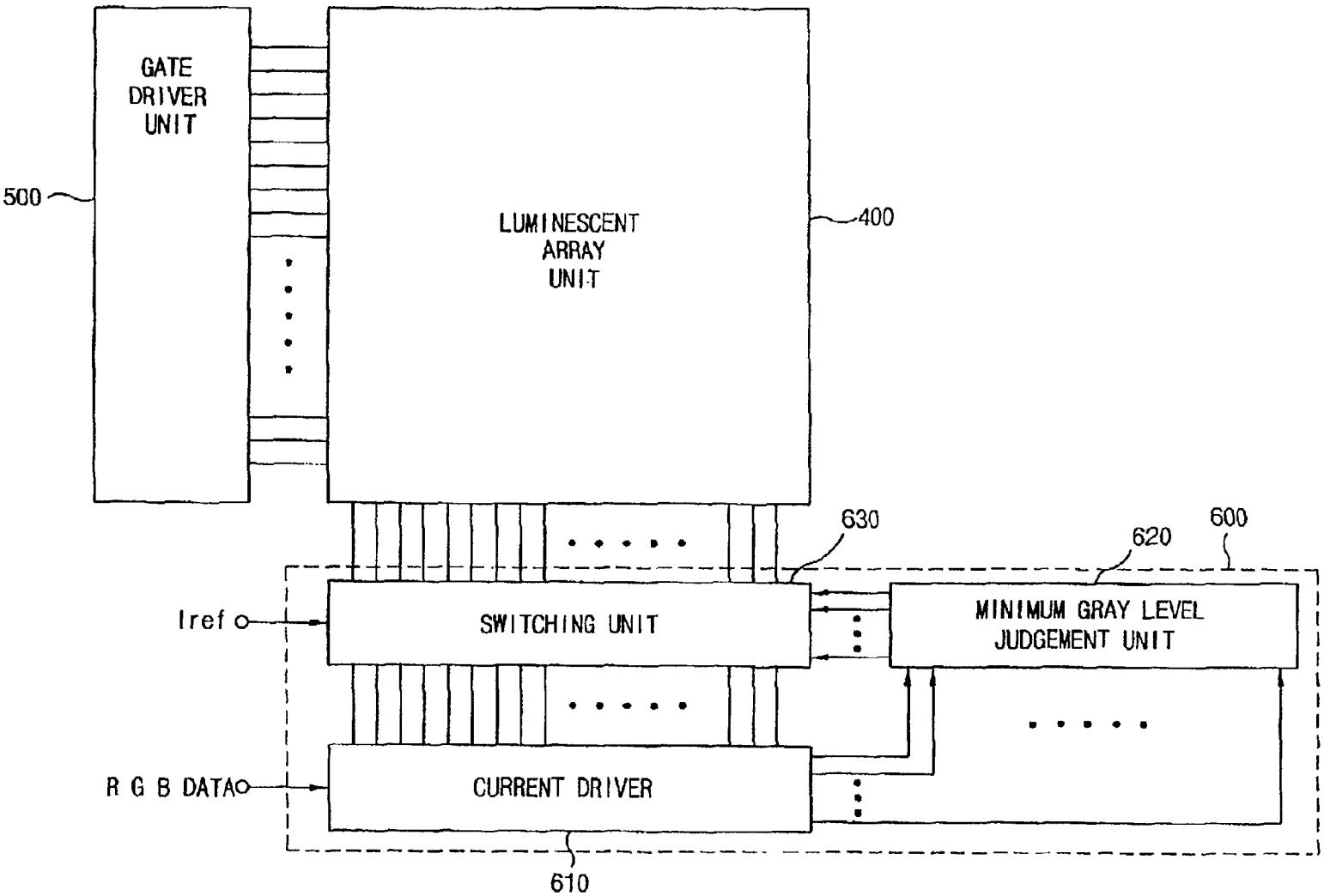
FIG. 8 illustrates a block diagram of a driving circuit of an organic electroluminescent device in accordance with another embodiment of the present invention.

FIG. 8 illustrates a block diagram of an organic electroluminescent device driving circuit in accordance with another embodiment of the present invention.

Referring to FIG. 8, an organic electroluminescent device driving circuit in accordance with another embodiment of the present invention includes a gate driver unit 500 for sequentially outputting a control signal to select gate lines in a luminescent array unit 400; and a current driver unit 600 for supplying picture data (e.g., RGB data) to data lines in the luminescent array unit 400 corresponding to gate lines that are selected by the gate driver unit 500 and, therefore, driving organic electroluminescent devices connected to the selected line. The current driver unit 600 includes a current driver 610 for receiving a digital picture data (e.g., an RGB data signal) from an external data source (not shown) and supplying the picture data to the data lines in the luminescent array unit 400 corresponding to gate lines that are selected by the gate driver unit 500, and therefore, selectively driving the organic electroluminescent devices connected to the selected line; a minimum gray level judgment unit 620 for judging whether the picture data applied from the current driver 610 to the selected organic electroluminescent device within the luminescent array unit 500 is of a predetermined minimum gray level; and a switching unit 630 for receiving a control signal dependent on the determination by the minimum gray level judgment unit 620 and for selectively supplying (e.g., turning on and/or off) a reference current (Iref) to the selected organic electroluminescent device.

The reference current (Iref) may be supplied through a current source (not shown).

Figure 9:
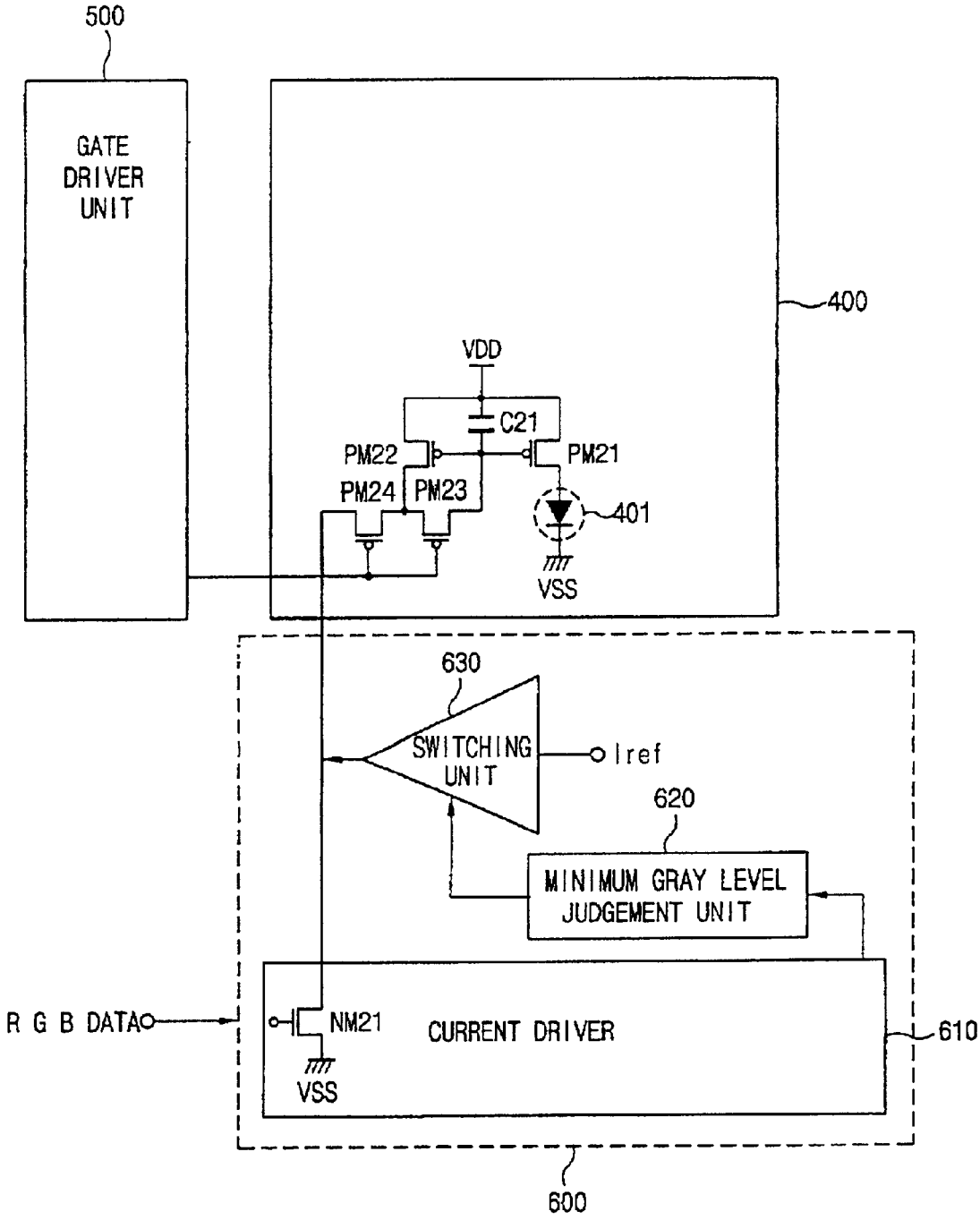
FIG. 9 illustrates an exemplary view of a organic electroluminescent device shown in FIG. 8.

FIG. 9 illustrates an exemplary view of an organic electroluminescent device driving circuit shown in FIG. 8 in accordance with another embodiment of the present invention.

Referring to FIG. 9, an organic electroluminescent device driving circuit in accordance with another embodiment of the present invention includes first and second PMOS transistors PM21 and PM22, wherein the sources of the first and second PMOS transistors are connected to a power supply voltage (VDD) and wherein gates of the are commonly connected; a first capacitor C21 connected between the power supply voltage (VDD) and the commonly connected gates of the first and second PMOS transistors PM21 and PM22; an organic electroluminescent device 401 connected between a drain of the first PMOS transistor PM21 and a ground (VSS); a source of a third PMOS transistor PM23 connected to the commonly connected gates of the first and second PMOS transistors; a drain of the third PMOS transistor PM23 connected to a drain of the second PMOS transistor PM22, so as to be energized as a gate of the third PMOS transistor receives a control signal from the gate driver unit 500; a source of a fourth PMOS transistor PM24 connected to the commonly connected drains of the second and third PMOS transistors PM22 and PM23, so as to be energized as a gate of the fourth PMOS transistor receives a control signal of the gate driver unit 500; a first NMOS transistor NM21, included within the current driver 610, connected between the drain of the fourth PMOS transistor PM24 and the ground (VSS), so as to be energized as a gate of the first NMOS transistor receives a gray level analog voltage corresponding to the picture data; a minimum gray level judgment unit 620 for receiving a digital value of the gray level analog voltage from the current driver 610 and determining whether the digital value of the gray level analog voltage is of a predetermined minimum gray level; and a switching unit 630 for receiving a control signal according to the determination of the minimum gray level judgment unit 620 and selectively supplying (e.g., turning on and/or turning off) a reference current (Iref) to the first NMOS transistor NM21.

A driving circuit operation in accordance with the present embodiment of the present invention will now be described.

Referring back to FIG. 8, when a gate line of the luminescent array unit 400 receives a control signal from a gate driver unit 500, a low potential signal from the organic electroluminescent device driving circuit is applied to the gates of the third and fourth PMOS transistors PM23 and PM24 so that the third and fourth PMOS transistors PM23 and PM24 may be energized.

As shown in FIG. 8, within the current driver unit 300, the gray level analog voltage corresponding to the picture data is applied to the gate of the first NMOS transistor NM21 thereby controlling the degree to which the first NMOS transistor NM21 is energized.

A proper voltage value may therefore outputted from the current driver unit 600 according to the gray level characteristics of each of the individual organic electroluminescent devices 401. For example, if a gray level is to be implemented as a 8 bit digital data signal, the current driver 600 converts digital values between a predetermined maximum gray level of, for example, '11111111' and a predetermined minimum gray level of, for example, '00000000' to analog voltage values through a digital/analog converter. The current driver 600 then applies the analog voltage values to the gate of the first NMOS transistors NM21, thereby controlling the degree to which the first NMOS transistors NM21 are energized.

When the third and fourth PMOS transistors PM23 and PM24 are energized, a predetermined amount of current flows through a first route beginning at the power voltage (VDD) to the second and fourth PMOS transistors PM23 and PM24, from the second and fourth PMOS transistors to the first NMOS transistor NM21, and from the first NMOS transistor to ground (VSS). The predetermined amount of current flows through the first route according to the degree to which the first NMOS transistor NM21 is energized by the analog voltage value supplied from the current driver unit 600. According to the principles of current mirroring, a predetermined current also flows through a second route beginning at the power voltage (VDD) then flowing to the first PMOS transistor PM21, then to organic electroluminescent device 401, and lastly to the ground (VSS) thereby controlling luminescence characteristics of the organic electroluminescent device 401.

If a predetermined maximum gray level is to be displayed by the organic electroluminescent device 401, the current driver unit 600 converts a digital value of, for example, '11111111' into a corresponding gray level analog voltage value and applies the corresponding gray level analog voltage to the gate of the first NMOS transistor NM21. Then, the degree to which the first NMOS transistor NM21 is energized, is maximized allowing a maximum amount of current to flow through the first route. Accordingly, the maximum amount of current also flows through the second route so that the predetermined maximum gray level may be displayed by the organic electroluminescent device 401.

If a predetermined minimum gray level is to be displayed by the organic electroluminescent device 401, the current driver unit 600 converts the digital value of, for example, '00000000' into a corresponding gray level analog voltage value and applies the corresponding gray level analog voltage value to the gate of the first NMOS transistor NM21. Then, the first NMOS transistor NM21 is turned off, e.g., placed in a floating state, such that no current flows through either the first or second routes so that the predetermined minimum gray level may be displayed by the organic electroluminescent device 401.

The gate driver unit 500 outputs a series of control signals so that the first through last gate lines in the luminescent array unit 400, in which a plurality of organic electroluminescent devices 401 are arranged, may be sequentially selected to display one frame of a picture on a screen.

Assuming that the organic electroluminescent device 401 illustrated in FIG. 9 is coupled to the first gate line of the luminescent array unit 400, the third and fourth PMOS transistors PM23 and PM24 may be energized when the first line is selected by the gate driver unit 500. Accordingly, an analog voltage value specific to the organic electroluminescent device may be applied to the gate of the first NMOS transistor NM21 by the current driver unit 600 to control the degree to which the first NMOS transistor NM21 is energized. Accordingly, a predetermined amount of current flows through the first and second routes so that a proper gray level may be indicated by the organic electroluminescent device 401.

After the first gate line has been selected by the gate driver unit 500, the next consecutive gate line is selected and the third and fourth PMOS transistors PM23 and PM24 of the first gate line are turned off. Accordingly, the gray level of the corresponding organic electroluminescent device 401 is maintained by the first capacitor C21 until the last gate line in the luminescent array unit 400 is selected, thereby displaying one frame of a picture on a screen.

Figure 10:
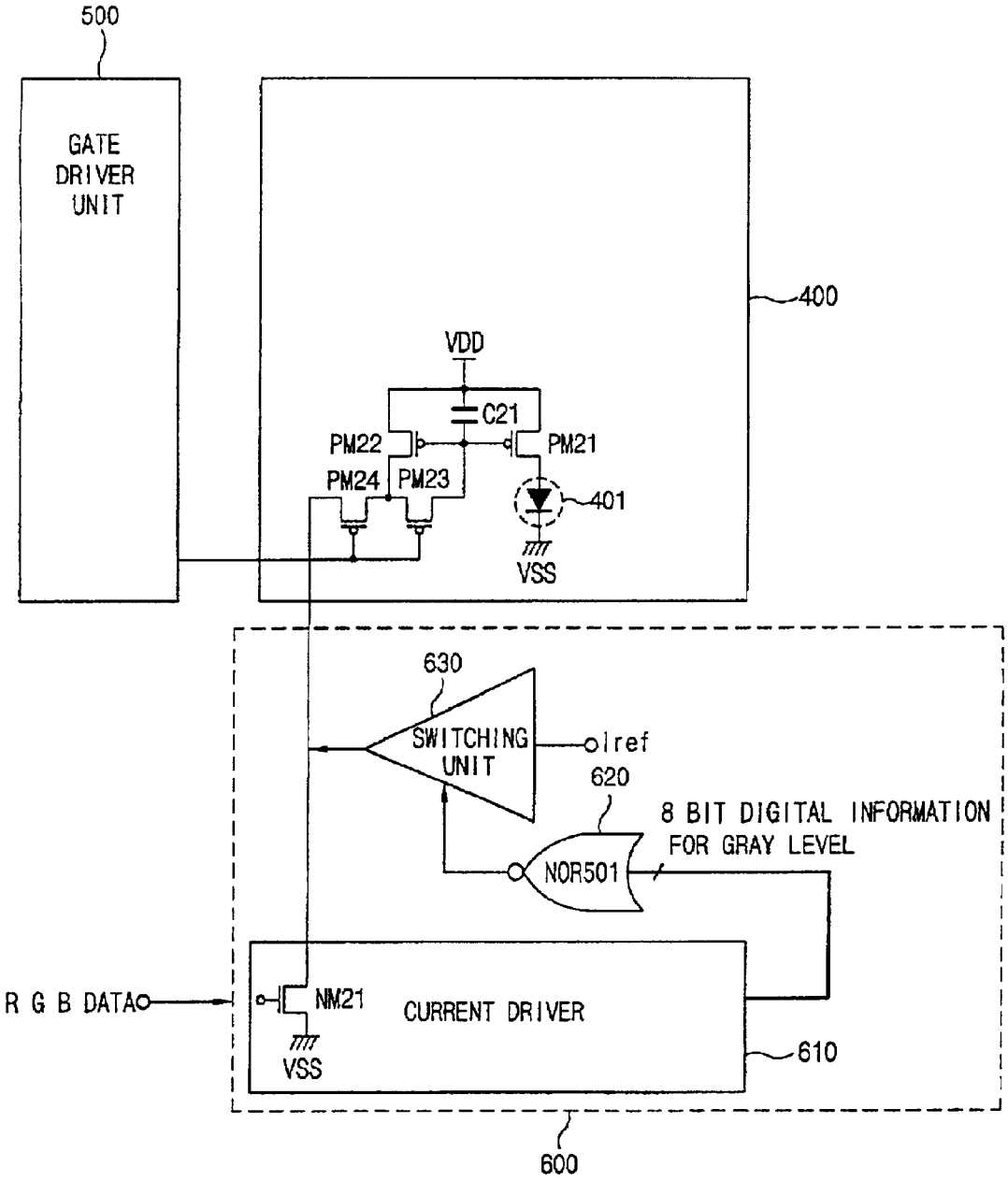
FIG. 10 illustrates an exemplary view of the minimum gray level judgment unit and switching unit shown in FIG. 9.

Referring now to FIG. 10, as discussed above, the minimum gray level judgment unit 620 may be installed in the current driver unit 600. The minimum gray level judgment unit 620 includes a NOR gate NOR501 that performs a NOR operation on the digital value of the gray level for the organic electroluminescent device generated by the current driver 610. Accordingly, when a digital value of a predetermined minimum gray level of, for example, '00000000' is inputted, the minimum gray level judgment unit 620 selectively outputs a logical 'high' potential, thereby indicating that the digital value has been determined to be of the predetermined minimum gray level.

The NOR gate NOR501 may be altered using an inverter. Accordingly, the inverter may invert the digital value of the gray level for an organic electroluminescent device outputted from the current driver 610. Further, an AND gate may be added to perform an AND operation on the output of the inverter in order to obtain the same output value.

Referring to FIG. 10, the switching unit 630 selectively supplies a reference current (Iref) to the first route if the NOR gate NOR501 outputs a logical 'high' potential.

A method of driving the organic electroluminescent device of the present invention will now be described with reference to FIG. 11.

Figure 11:
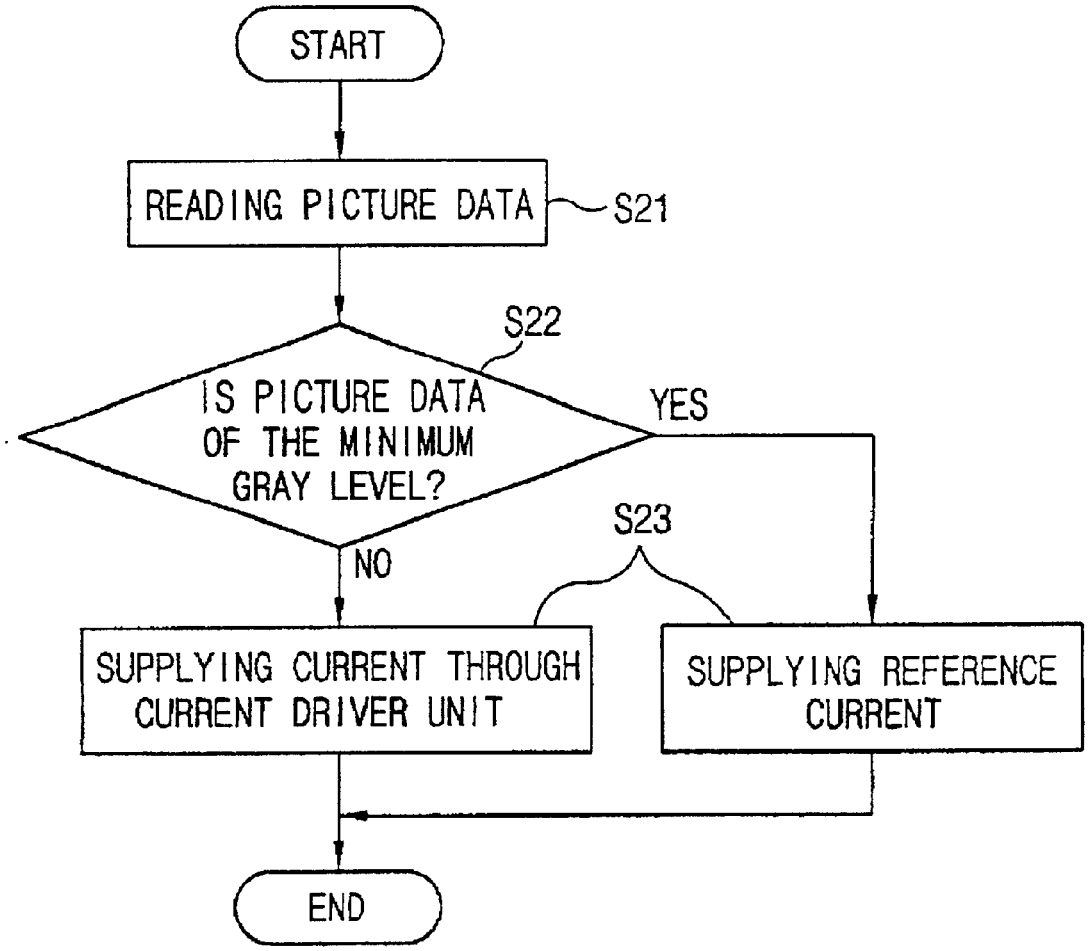
FIG. 11 illustrates a flow chart of a method of driving the organic electroluminescent device in accordance with the present invention.

Referring to FIG. 11, picture data is supplied to the organic electroluminescent device of the luminescent array unit selected by the gate driver unit and the current driver unit is read (step S21).

Next, it is determined whether the read picture data contains a digital value of a predetermined minimum gray level (step S22).

If the picture data does not contain a digital value of the predetermined minimum gray level, the corresponding organic electroluminescent device luminesces using a current received from the current driver unit. If, however, the picture data does contain a digital value of the predetermined minimum gray level, the corresponding organic electroluminescent device receives no current from the current driver unit. However, a reference current is supplied to the corresponding organic electroluminescent device (step S23).

Accordingly, when an organic electroluminescent device displays a predetermined gray level in a first frame of a picture and then displays the predetermined minimum gray level in a second, consecutive, frame, the reference voltage (Vref) may be supplied to the first route so that the organic electroluminescent device can display the predetermined gray level and then immediately display the minimum gray level.

Figure 12:
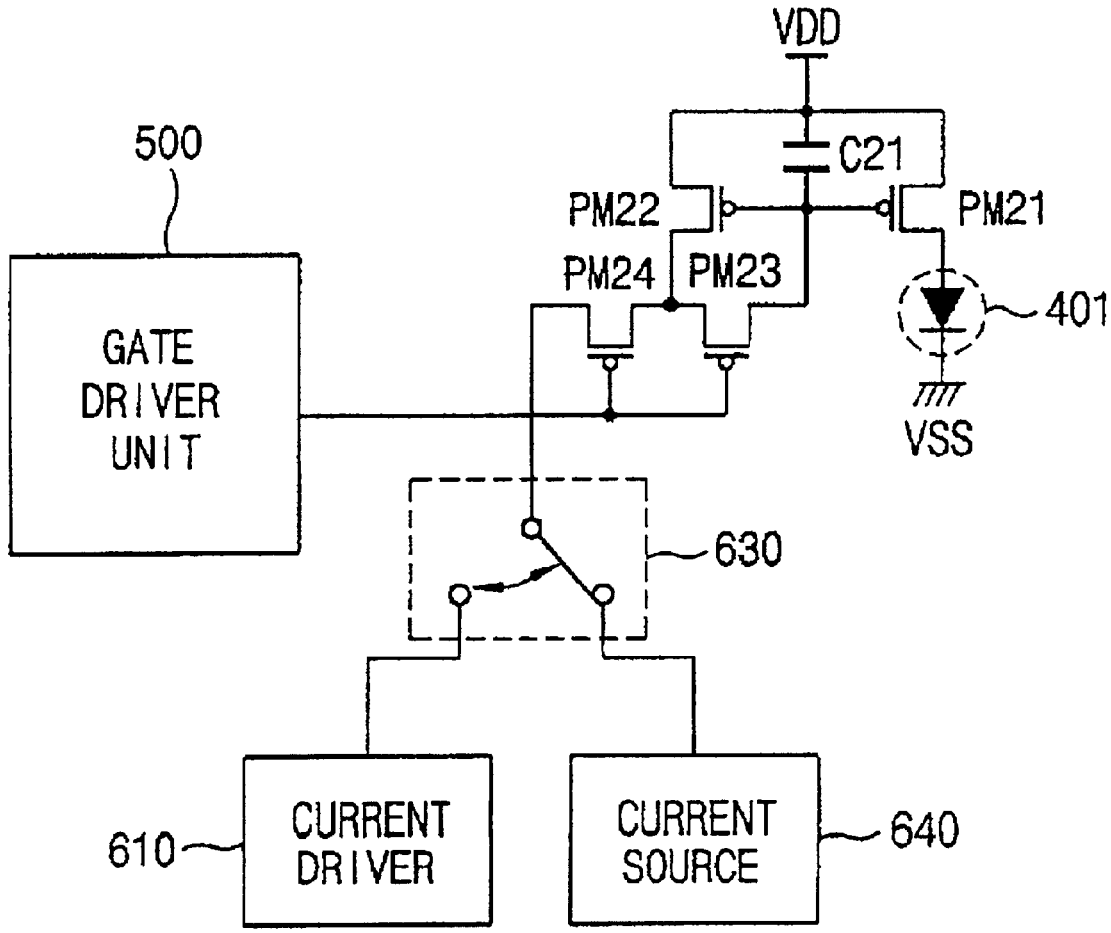
FIG. 12 illustrates an exemplary view of a driving apparatus of an organic electroluminescent device in accordance with one embodiment of the present invention.

FIG. 12 illustrates an exemplary view of a driving apparatus of an organic electroluminescent device in accordance with one embodiment of the present invention.

Referring to FIG. 12, when the organic electroluminescent device 401 displays a predetermined gray level, the current driver 610 may be connected to the organic electroluminescent device driving circuit via the switching unit 630, and the third and fourth PMOS transistors PM23 and PM24. An analog voltage corresponding to the digital picture data signal may be applied to the gate of the first NMOS transistor NM21 to control the degree to which the first NMOS transistor NM21 is energized. Accordingly, the current flowing to the organic electroluminescent device 401 may be controlled as required such that a predetermined gray level is displayed by the organic electroluminescent device.

When the organic electroluminescent device 401 displays a predetermined gray level, the first NMOS transistor NM21 is turned off. Further, the current source 640 supplies the reference current (Iref) to the organic electroluminescent device driving circuit via a connection made by the switching unit 630. When the organic electroluminescent device 401 displays the predetermined minimum gray level, the first and second PMOS transistors PM21 and PM22 are turned off and the current flowing to the organic electroluminescent device 401 is turned off so that the predetermined minimum gray level is displayed by the organic electroluminescent device.

According to the principles of the present invention, when an organic electroluminescent device consecutively displays a predetermined gray level in a first frame and then displays a predetermined minimum gray level in a second frame, a reference voltage or a reference current may be selectively supplied so that the organic electroluminescent device may display the predetermined gray level and then immediately display the predetermined minimum gray level. Accordingly, an accurate gray level may be expressed and the organic electroluminescent devices may be driven with a quick response speed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A driving circuit of an organic electroluminescent device having a gate driver unit for sequentially outputting a control signal to select gate lines within a luminescent array unit, the driving circuit comprising:

a current driver receiving picture data;

a minimum gray level judgment unit connected to an output of the current driver, the minimum gray level judgement unit determining whether the picture data is of a predetermined minimum gray level; and a switching unit connected to an output of the minimum gray level judgement unit and to the output of the current driver, the switching unit receiving a control signal corresponding to the determination made by the minimum gray level judgment unit and selectively supplying a reference voltage or the picture data to the selected organic electroluminescent device in correspondence with the received control signal.

2. The circuit of claim 1, wherein the minimum gray level judgment unit comprises a NOR gate for receiving a digital value of a predetermined gray level from the current driver unit, performing a NOR operation on the received digital value, and outputting the control signal to the switching unit.

3. The circuit of claim 1, wherein the minimum gray level judgment unit comprises:

an inverter for receiving a digital value of a predetermined gray level from the current driver unit and for inverting the received digital value; and an AND gate for performing an AND operation of the output of the inverter and for outputting the control signal to the switching unit.

4. The circuit of claim 1, further comprising a voltage driver for supplying the reference voltage.

5. A driving circuit of an organic electroluminescent device having a gate driver unit for sequentially outputting a control signal to select gate lines within a luminescent array unit, the driving circuit comprising:

a current driver receiving picture data;

a minimum gray level judgment unit connected to an output of the current driver, the minimum gray level judgement unit determining whether the picture data is of a predetermined minimum gray level; and a switching unit connected to an output of the minimum gray level judgement unit and to the output of the current driver, the switching unit receiving a control signal corresponding to the determination made by the minimum gray level judgment unit and selectively supplying a reference signal or the picture data to the selected organic electroluminescent device in correspondence with the received control signal.

6. The circuit of claim 5, wherein the minimum gray level judgment unit comprises a NOR gate for receiving a digital value of a predetermined gray level from the current driver unit, performing a NOR operation on the received digital value, and outputting the control signal to the switching unit.

7. The circuit of claim 5, wherein the minimum gray level judgment unit comprises:

an inverter for receiving a digital value of a predetermined gray level from the current driver unit and for inverting the received digital value; and an AND gate for performing an AND operation of the output of the inverter and for outputting the control signal to the switching unit.

8. The circuit of claim 5, wherein the reference signal comprises a reference voltage.

9. The circuit of claim 5, wherein the reference signal comprises a reference current.

10. A driving circuit of an organic electroluminescent device having a gate driver unit for sequentially outputting a control signal to select lines within a luminescent array unit, the driving circuit comprising:

a current driver receiving picture data;

a minimum gray level judgment unit connected to an output of the current driver, the minimum gray level judgement unit determining whether the picture data is of a predetermined of a predetermined minimum gray level; and a switching unit connected to an output of the minimum gray level judgement unit and to the output of the current driver, the switching unit receiving a control signal corresponding to the determination made by the minimum gray level judgment unit and selectively supplying a reference current or the picture data to the selected organic electroluminescent device in correspondence with the received control signal.

11. The circuit of claim 10, wherein the minimum gray level judgment unit comprises a NOR gate for receiving a digital value of a predetermined gray level from the current driver unit, performing a NOR operation on the received digital value, and outputting the control signal to the switching unit.

12. The circuit of claim 10, wherein the minimum gray level judgment unit comprises:

an inverter for receiving a digital value of a predetermined gray level from the current driver unit and for inverting the received digital value; and an AND gate for performing an AND operation of the output of the inverter and for outputting the control signal to the switching unit.

13. The circuit of claim 10, further comprising: a current source for supplying the reference current.

14. A method of driving an organic electroluminescent device, comprising:

reading picture data supplied to predetermined organic electroluminescent devices within a luminescent array unit, wherein the predetermined organic electroluminescent devices are selected by a gate driver unit and a current driver unit;

determining whether the read picture data is of a predetermined minimum gray level; and using the picture data to drive the organic electroluminescent devices with the current driver unit, wherein the current driver unit supplies current to predetermined organic electroluminescent devices if the picture data is not of the predetermined gray level, wherein the current driver unit cuts off the current supplied to the predetermined organic electroluminescent devices if the picture data is of the predetermined gray level, wherein a reference voltage is supplied to the predetermined organic electroluminescent devices when the picture data is of the predetermined gray level.

15. A method of driving an organic electroluminescent device, comprising:

reading picture data supplied to predetermined organic electroluminescent devices within a luminescent array unit, wherein the predetermined organic electroluminescent devices are selected by a gate driver unit and a current driver unit;

determining whether the read picture data is of a predetermined minimum gray level; and using the picture data to drive the organic electroluminescent devices with the current driver unit, wherein the current driver unit supplies current to the predetermined organic electroluminescent devices if the picture data is not of the predetermined gray level, wherein the current driver unit cuts off the current supplied to the predetermined organic electroluminescent devices if the picture data is of the predetermined gray level, wherein a reference current is supplied to the predetermined organic electroluminescent devices when the picture data is of the predetermined gray level.

16. A method of driving an organic electroluminescent device, comprising:

receiving picture data to be supplied to predetermined organic electroluminescent devices within a luminescent array unit, wherein the predetermined organic electroluminescent devices are selected by a gate driver unit and a current driver unit;

determining whether the received picture data is of a predetermined minimum gray level; and using the picture data to drive the organic electroluminescent devices with the current driver unit, wherein the current driver unit supplies current to predetermined organic electroluminescent devices if the picture data is not of the predetermined gray level, wherein the current driver unit cuts off the current supplied to the predetermined organic electroluminescent devices if the picture data is of the predetermined gray level, wherein a reference voltage is supplied to the predetermined organic electroluminescent devices when the picture data is of the predetermined gray level.

* * * * *